US007421804B1

(12) United States Patent
Hession

(10) Patent No.: US 7,421,804 B1
(45) Date of Patent: Sep. 9, 2008

(54) DEVICE FOR ATTACHING AN EXHAUST HOSE TO A CLOTHES DRYER

(76) Inventor: Edward B. Hession, 203 S. 18th St., Lafayette, IN (US) 47905

( * ) Notice: Subject to any disclaimer, the term of this patent is extended or adjusted under 35 U.S.C. 154(b) by 0 days.

(21) Appl. No.: 11/346,034

(22) Filed: Feb. 2, 2006

(51) Int. Cl.
*F26B 11/02* (2006.01)

(52) U.S. Cl. ..... 34/601

(58) Field of Classification Search ..... 34/601
See application file for complete search history.

(56) References Cited

U.S. PATENT DOCUMENTS

| | | | |
|---|---|---|---|
| 5,121,948 | A | 6/1992 | Anderson et al. |
| 5,257,468 | A | 11/1993 | Lebrun |
| 5,318,328 | A | 6/1994 | Dawson |
| 5,463,820 | A | 11/1995 | La Rue |
| 5,584,129 | A | 12/1996 | Williamson |
| 5,653,631 | A | 8/1997 | Anderson et al. |
| 5,970,623 | A | 10/1999 | Tuggle |
| 6,098,312 | A | 8/2000 | Tuggle |
| 6,195,910 | B1 | 3/2001 | Robineau |
| 6,230,418 | B1 | 5/2001 | Gomulinski |
| 6,370,794 | B1 | 4/2002 | Tuggle |
| 6,419,102 | B1 | 7/2002 | Harpenau |
| 6,463,673 | B1 | 10/2002 | Gherna |
| 6,584,702 | B2 | 7/2003 | Irey |
| 6,729,586 | B2 | 5/2004 | Arguijo |
| 2004/0078995 | A1 | 4/2004 | Forget et al. |
| 2004/0237330 | A1 | 12/2004 | Fuller |

*Primary Examiner*—S. Gravini
(74) *Attorney, Agent, or Firm*—Mathew R. P. Perrone; Brie A. Crawford

(57) ABSTRACT

A device for attaching an exhaust channel between a clothes dryer and a wall or floor vent, the device having a bracket connecting to the exhaust channel, includes a bracket having a dryer connector and an end connected to the exhaust channel. The bracket is sufficiently elongated to permit insertion of the dryer connector from the front of the dryer while permitting the opposing end thereof to be attached to the exhaust channel connected to the wall or floor vent. An opposing dryer bracket may be mounted on the back of the dryer to support the attachment of the bracket. Reinforcing this connection is a channel formed at the base of the dryer bracket. An edge of the bracket is placed within the dryer bracket thereby providing a secure connection. Additionally, the dryer bracket may contain a fastening device, which fastens and locks onto the vent bracket for further support.

16 Claims, 9 Drawing Sheets

DEVICE FOR ATTACHING AN EXHAUST HOSE TO A CLOTHES DRYER

This invention relates to a device for attaching an exhaust pipe to a clothes dryer and more particularly to a device for attaching an exhaust hose or pipe to a dryer which permits the pipe to be conveniently attached to or detached from the dryer, when the dryer is in a cramped or difficult to reach place

BACKGROUND OF THE INVENTION

Every clothes dryer requires an exhaust channel to function efficiently. Normally, the exhaust channel has a hose attached to a dryer connector at one end and wall or floor vent at the other. In order to simplify the attaching of the exhaust channel, a flexible hose is known and used. However, for safety reasons, in some cases, use of the flexible hose is restricted. With such a restriction, installation of a clothes dryer becomes more difficult.

A clothes dryer is difficult to move. Yet, movement of the clothes dryer is mandatory for connection and cleaning of the exhaust channel. If a method can be found, which reduces the movement of the clothes dryer while installing the exhaust channel, great advantages can be obtained.

If the flexible hose is not used, a metal pipe is the desired replacement for the exhaust channel. Since the installation of the dryer is often in a very confined space, it becomes difficult to maneuver and attach the metal pipe to the dryer at one end and the exhaust vent at the other end, so a minimal length of flexible hose is used to connect an exhaust channel to a dryer exhaust outlet. While the flexible hose stands a better chance of collecting lint than the metal pipe, both types do collect lint and thereby present a fire hazard. As the length of the exhaust hose or pipe increases, the danger of lint collection increases, as does the fire danger. In order to keep the exhaust channel free of lint during operation of the dryer, the exhaust pipe must be detached from the clothes dryer occasionally to give access for inspection and removal of any accumulated lint. This is very desirable to minimize the danger of such fire. Thus, the prior art suffers from numerous drawbacks for the connection and disconnection of the exhaust channel. If the connection and disconnection can be simplified, while improving fire safety, great advantages can be obtained.

SUMMARY OF THE INVENTION

Among the many objectives of this invention is the provision of a device for attaching an exhaust channel between a clothes dryer and a wall or floor vent, which permits a connection and disconnection of the exhaust channel in an unencumbered fashion while at the same time maintaining the maximum airflow efficiency of the dryer.

A further objective of this invention is the provision of a device for facilitating a convenient access for the removal of lint from the exhaust channel of a dryer.

Another objective of this invention is the provision of a device for facilitating the removal of lint from the rear proximity of the dryer.

Yet a further objective of this invention is the provision of a device, which allows a user to connect the exhaust channel from while standing in front of the clothes dryer.

A still further objective of this invention is the provision of a device for connecting an exhaust channel to a clothes dryer, which is easily installed.

Also an objective of this invention is the provision of a device, which allows a user to disconnect the exhaust channel while standing in front of the dryer.

Another objective of this invention is the provision of a device for connecting an exhaust channel to a clothes dryer, which greatly simplifies such attachment.

A still further objective of this invention is the provision of a device which reduces the drying time of the materials dried in the dryer.

Yet a further objective of this invention is the provision of a device which produces a quicker drying time in a dryer.

Still a further objective of this invention is the provision of a device which reduces the wear and tear on the dried materials in a dryer.

Yet a further objective of this invention is to provide a device to facilitate the attachment and detachment of an exhaust channel for a dryer for convenient inspection and cleaning in and around the exhaust channel which greatly reduces the risk of fire.

A still further objective of this invention is to provide a device which allows a minimum length exhaust channel between the dryer and the wall or floor vent further enhancing efficient airflow and thereby reducing the accumulation of lint and the fire hazard.

These and other objectives of the invention (which other objectives become clear by consideration of the specification, claims and drawings as a whole) are met by providing a device for attaching an exhaust channel between a clothes dryer and a wall or floor vent, which device is sufficiently elongated to permit remote attachment of a dryer connector to the dryer end thereof while permitting the opposing end thereof to be attached to the wall or floor vent with the dryer in its final space.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

This device simplifies the attachment of the exhaust channel to the clothes dryer, in a difficult to access space behind the dryer. This structure allows the length of the exhaust channel to be kept to a minimum, thereby allowing optimum air velocity through the exhaust channel from the dryer. This also helps in reducing the tendency of the system to collect lint, because of the more efficient air flow.

The device for attaching an exhaust channel to a clothes dryer not only provides a quick and positive detachable connector, but it may be operated from a standing position in front of the dryer, with little or no need to move the dryer away from the wall. Consequently, this device reduces the risk of fire by lowering the probability of lint collection through the use of a shorter exhaust channel. Furthermore, the device reduces the risk of fire by providing easy access for the removal of any collected lint. At the same time, the device allows for quicker drying times resulting in energy savings and a reduction of the wear and tear on both the dryer and the clothes or other materials dried.

Figure 1:
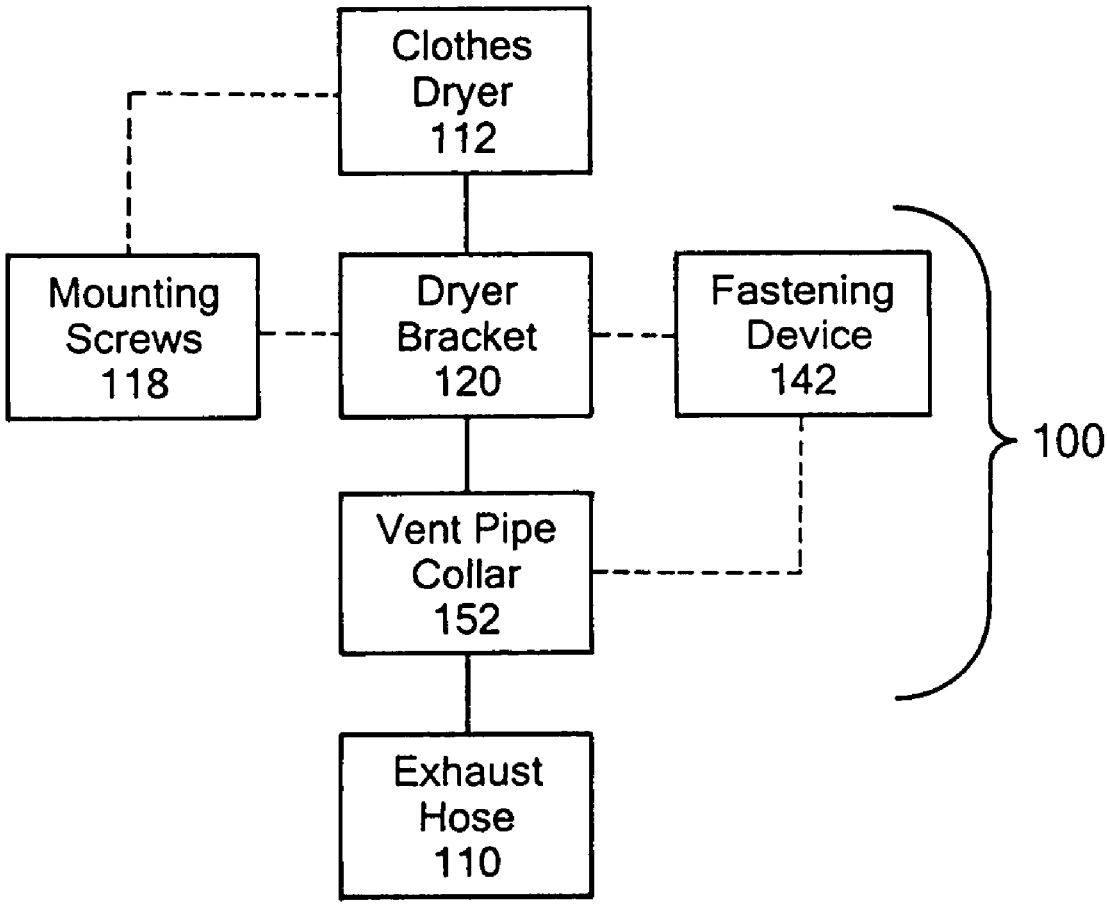
FIG. 1 depicts a block diagram of attaching device 100 for attaching an exhaust or an exhaust hose 110 to a dryer 112.

Referring now to FIG. 1, attaching device 100 for attaching an exhaust hose 110 to a clothes dryer 112 is operable from the front 114 (FIG. 2) of dryer 112, in order to properly attach exhaust hose 110 to dryer 112. In this fashion, the exhaust hose 110 may be attached to dryer 112 from the front 114 thereof without or with minimal moving of the dryer 112. The attaching device 100 may be attached to clothes dryer 112 by a fastening device 106, such as bendable tabs, a magnetic catch, a mechanical spring catch, a slip ring retainer, screws or nuts and bolts, a twist tab and slot and the like.

Figure 2:
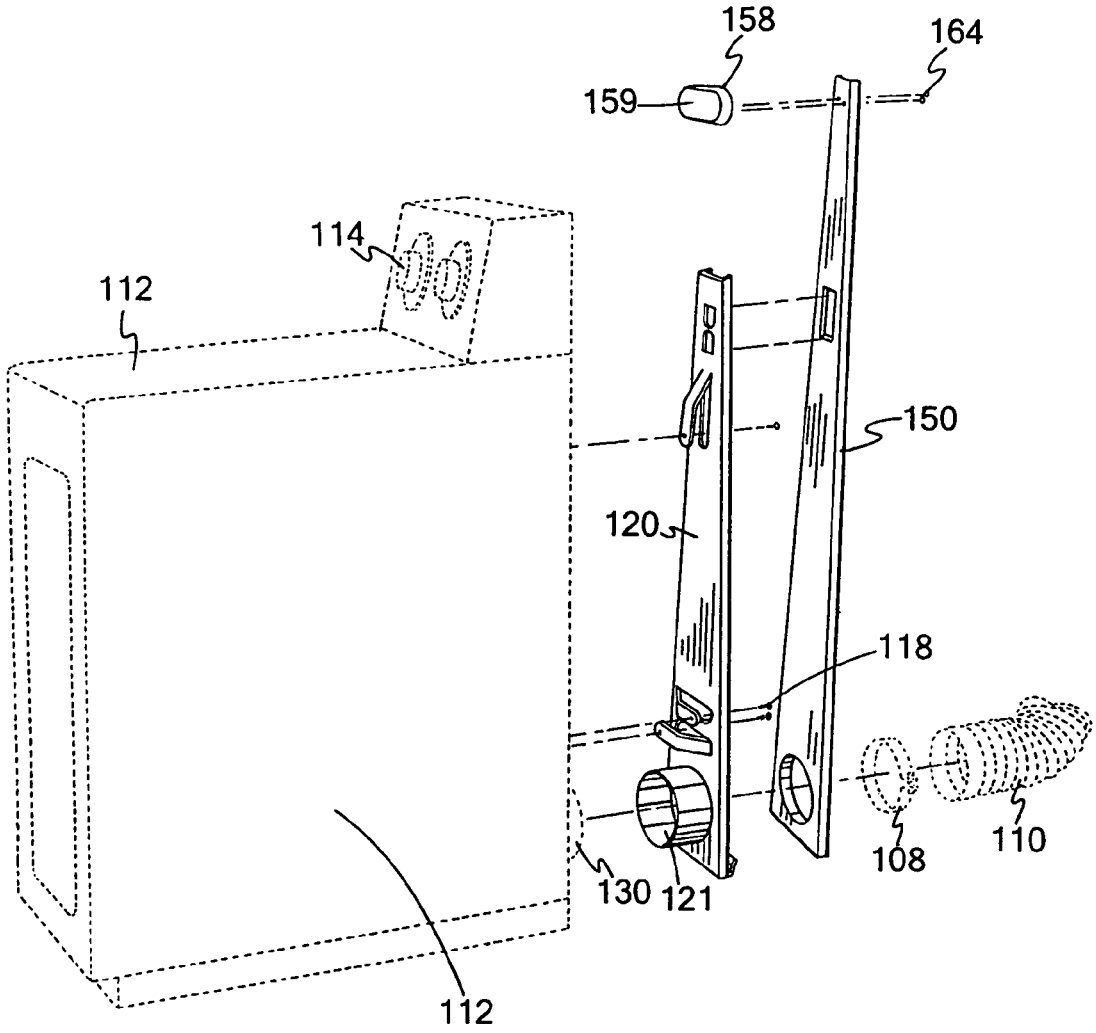
FIG. 2 depicts an exploded, perspective view of attaching device 100 in relation to dryer 112.
Figure 3:
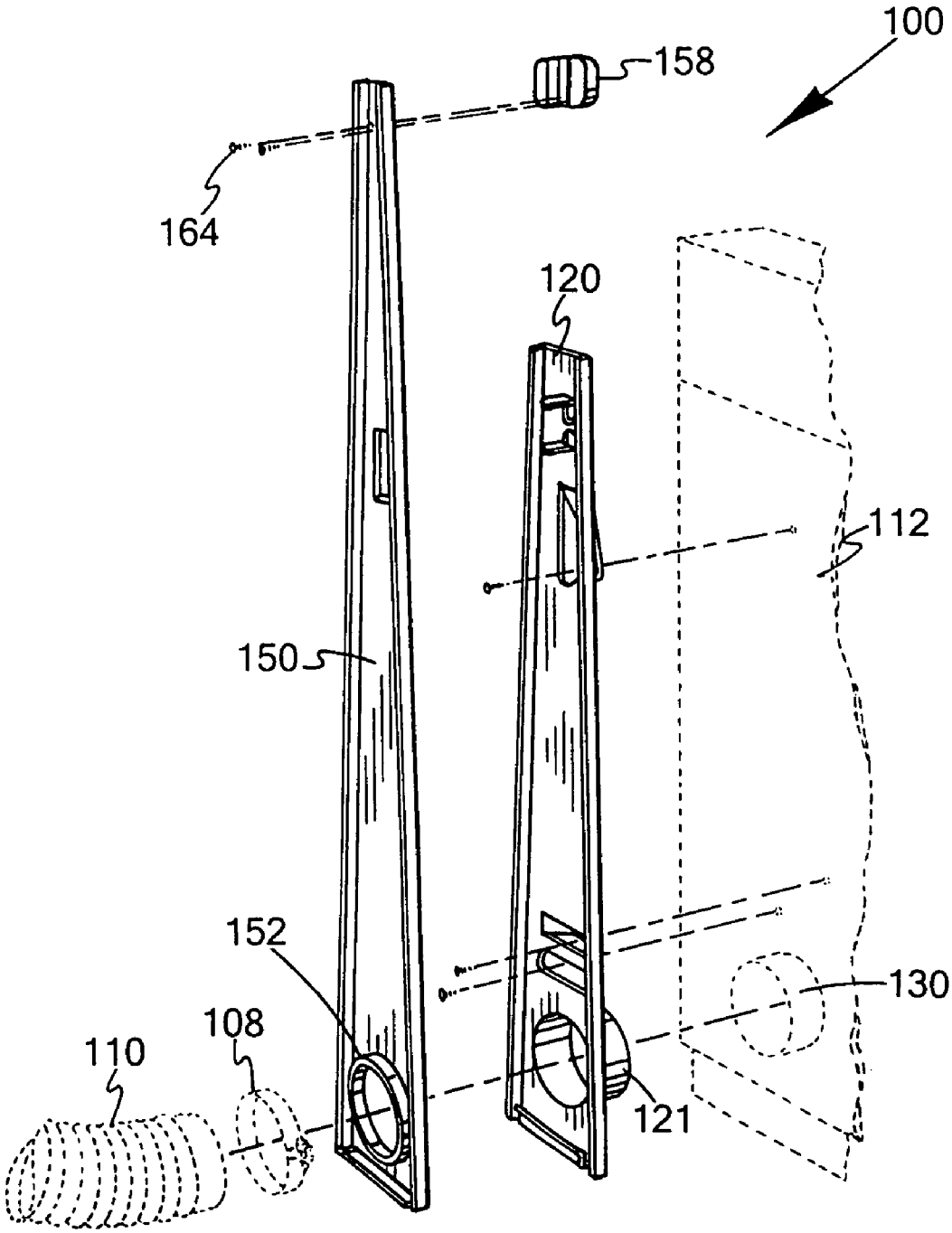
FIG. 3 depicts an exploded, perspective view of attaching device 100 in relation to dryer 112 shown in phantom based on a reverse view of FIG. 2.
Figure 4:
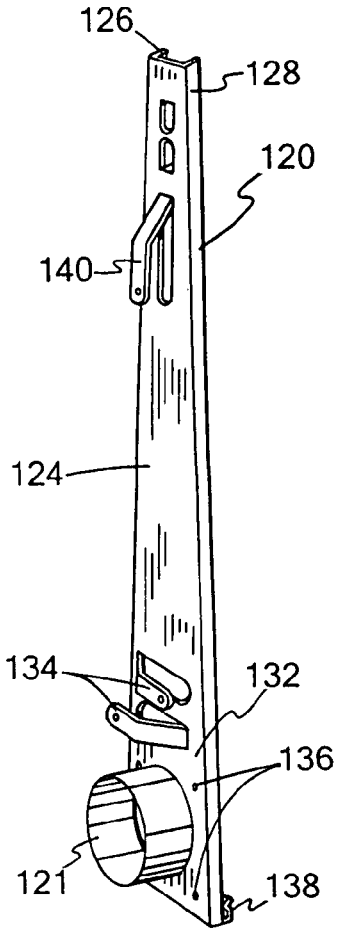
FIG. 4 depicts a perspective view of dryer bracket 120 for attaching device 100.
Figure 5:
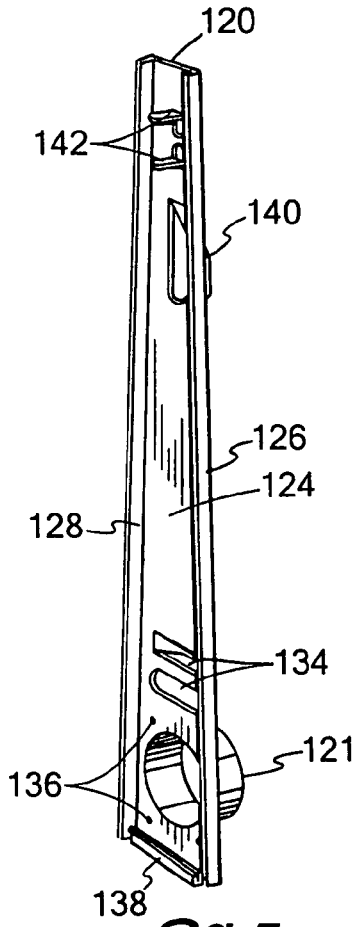
FIG. 5 depicts a perspective view of dryer bracket 120 for attaching device 100 based on a reverse view of FIG. 4.
Figure 6:
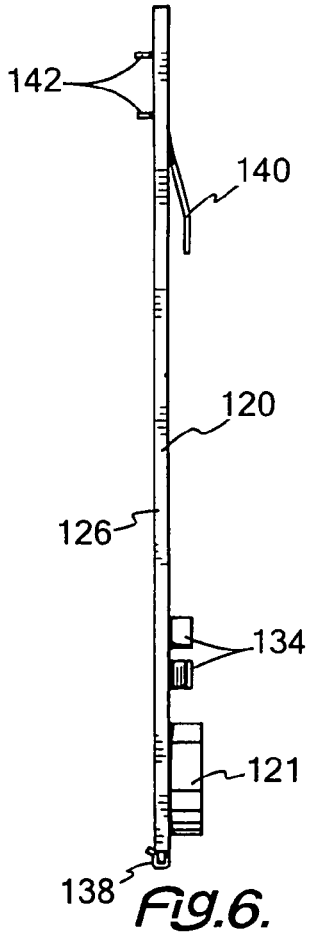
FIG. 6 depicts a side view of dryer bracket 120 for attaching device 100.
Figure 7:
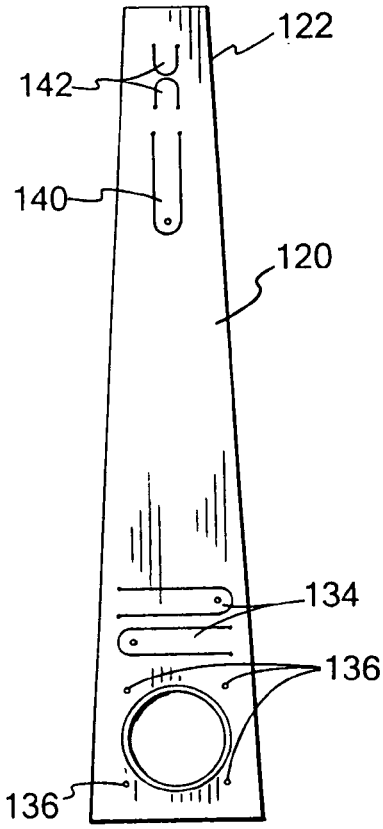
FIG. 7 depicts a front plan view of dryer bracket 120 for attaching device 100.
Figure 8:
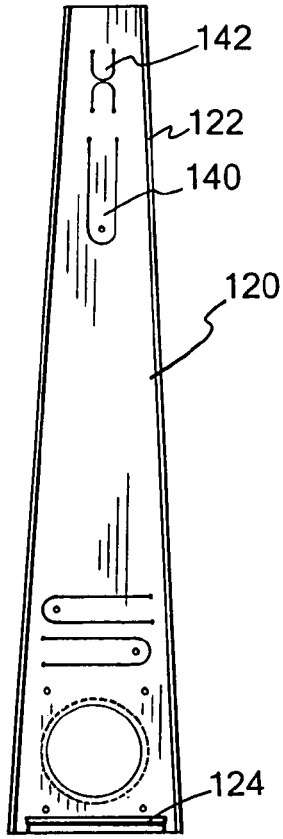
FIG. 8 depicts a rear plan view of dryer bracket 120 for attaching device 100.
Figure 9:
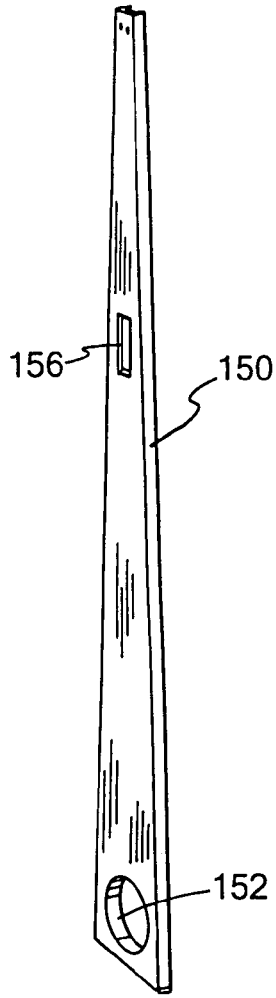
FIG. 9 depicts a perspective view of vent pipe bracket 150 which mates to dryer bracket 120.
Figure 10:
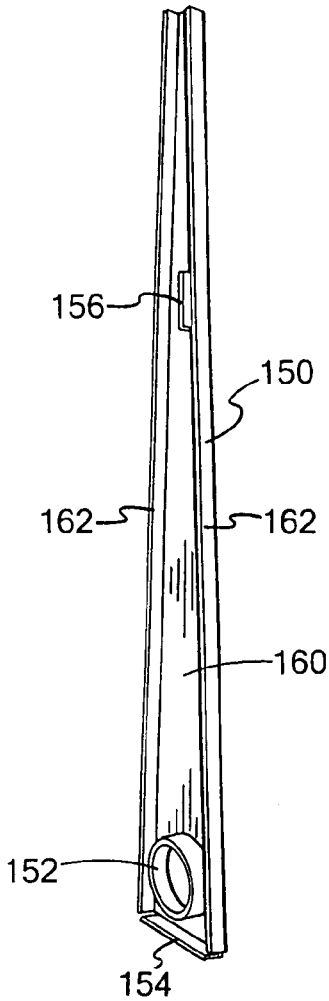
FIG. 10 depicts a perspective view of vent pipe bracket 150 which mates to dryer bracket 120 based on reverse view of FIG. 9.
Figure 11:
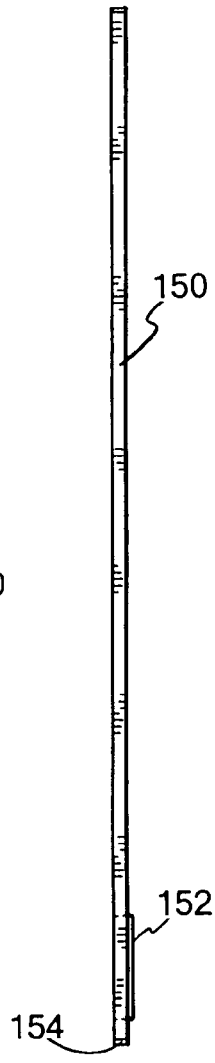
FIG. 11 depicts a side view of vent pipe bracket 150 which mates to dryer bracket 120.
Figure 12:
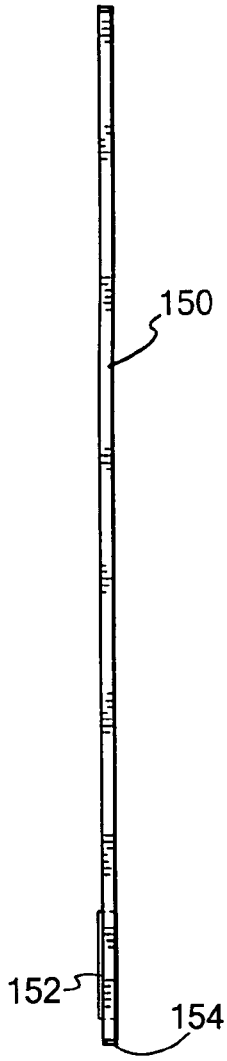
FIG. 12 depicts a side view of vent pipe bracket 150 which mates to dryer bracket 120.
Figure 13:
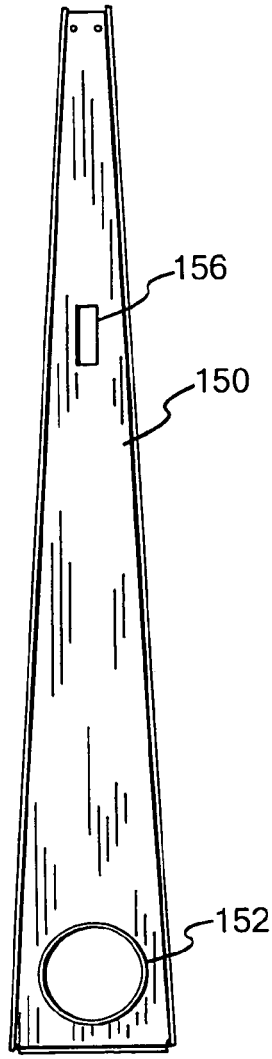
FIG. 13 depicts a front plan view of vent pipe bracket 150 which mates to dryer bracket 120.

Adding FIG. 2 and FIG. 3 to the consideration, attaching device 100 in relation to dryer 112 has a dryer bracket 120 and a vent pipe bracket 150. The vent pipe bracket 150 has a handle 158 fixed thereto by attachment screws 164. This handle 158 enables attachment of the exhaust hose 110 to dryer 112 from the front 114 of the dryer 112.

The dryer bracket 120 may be added to dryer 112 with mounting screws 118 as an add-on or after market part. Dryer bracket collar 121 slips over dryer collar 130. Dryer bracket 120 also may be manufactured as a part of dryer 112. The key is that the mounting functions of dryer bracket 120 be available to secure vent pipe bracket 150 thereto. Pipe bracket 150 is held to exhaust hose 110 by hose clamp 108.

Further considering FIG. 4, FIG. 5, FIG. 6, FIG. 7, and FIG. 8, dryer bracket 120 is attached to dryer 112. Dryer bracket 120 has a tapered housing 122. Tapered housing 122 includes a housing base 124 with a first base vertical side rail 126 and a second base vertical side rail 128 oppositely disposed therefrom. The dryer bracket 120 includes a bracket collar 121 adjacent to base 124 of dryer bracket 120. Bracket collar 121 fits onto dryer collar 130, which may come with dryer 112 for the attachment of exhaust hose 110.

In accordance with the preferred embodiment, the dryer bracket comes as an add-on or after market part. Several means exist for the attachment of the dryer bracket 120 to the dryer 112. Preferably, two lower mounting feet 134 and an upper mounting foot 140 are provided. In this embodiment, the lower mounting feet 134 are positioned just above a dryer collar 130 while the upper mounting foot 140 is placed just below the top of the dryer bracket 120. Lower mounting feet 134 extend in parallel yet opposite horizontal directions and are separated by a small offset distance along the vertical dimension of the dryer bracket 120.

Upper mounting foot 140 extends in a vertical direction toward the bottom of the dryer 112. The mounting feet 134 and 140 jut out of the dryer bracket 120 and are adjacent to the back of the dryer 112 when mounted. Each mounting foot 134 and 140 contains a mounting foot aperture 137.

The dryer bracket 120 includes a bracket collar 121 adjacent to the base 124 of dryer bracket 120. Bracket collar 121 fits onto dryer collar 130, which comes with dryer 112. Lower mounting feet 134 are within housing base 124 of dryer bracket 120 and may be bent or otherwise shaped to assist with the attaching of the dryer bracket 120 to the dryer 112.

If desired, mounting apertures 136, surrounding the bracket collar 121 can additionally or optionally secure the dryer bracket 120 to dryer 112. Adjacent to the bracket collar 121 at the base of dryer bracket 120 is channel 138. Channel 138 helps support, locate, or capture vent pipe bracket 150 on the dryer 112, by being vertical in relation to housing base 124. Cutouts 146 add further support. Dryer collar 130 may be trimmed to fit dryer bracket 120 closer to the back of dryer 112 for easier mounting.

Oppositely disposed from bracket collar 121 in housing base 124 is upper mounting foot 140. Upper mounting foot 140 serves the same purpose as lower mounting feet 134. Adjacent to upper mounting foot 140 is base fastening device 142, used to secure vent pipe bracket 150 to dryer bracket 120. Clearly, mounting aperture 136 or lower mounting feet 134 can be optionally used at the discretion of the installer to properly and securely mount dryer bracket 120 to the back of the dryer 112.

With the additional consideration of FIG. 9, FIG. 10, FIG. 11, FIG. 12, and FIG. 13, the structures of vent pipe bracket 150 in combination with dryer bracket 120 can be determined. Vent pipe collar 152 receives exhaust hose 110 from wall or floor vent for dryer 112. The vent pipe bracket 150 can be mounted on dryer bracket 120 with vent pipe collar 152 aligned.

Assisting with such mounting is channel support 154 which fits into channel 138. Vent pipe bracket 150 has a shape similar to that of dryer bracket 120. Vent pipe collar 152 aligns with bracket collar 121. Cutouts 146 receive fastening device 142 on dryer bracket 120 to further support joining Vent pipe bracket 150 has a vent base 160 with vent rails 162 on either long side thereof. Vent rails 162 cooperate with first base vertical side rail 126 and a second base vertical side rail 128 to releasably join vent pipe bracket 150 and dryer bracket 120. Exhaust hose 110 can be mounted on vent pipe collar 152 before such joining is done. Locking slot 156 receives fastening device 142 of dryer bracket 120 to provide for a secure support.

Handle 158 on vent pipe bracket 150 simplifies the attaching process. Handle 158 provides a front surface 159, in order to display information in the form of a product name or logo, a company address, a web side, product instructions, warnings, advertisements or other desired material. Consequently, vent pipe bracket 150 may be of sufficient height above the dryer 112 so as to permit users to legibly read messages written on the front surface 159 of the handle 158.

Additionally, the handle 158 permits the exhaust hose 110 to be simply attached to the dryer 112. Exhaust hose 110 is first attached to vent pipe collar 152. Then vent pipe bracket 150 is secured to dryer bracket 120 from the front 114 of dryer 112. While any method can be used to install the dryer bracket 120, normally installation is achieved by a user standing in front 114 of the dryer 112.

Figure 14:
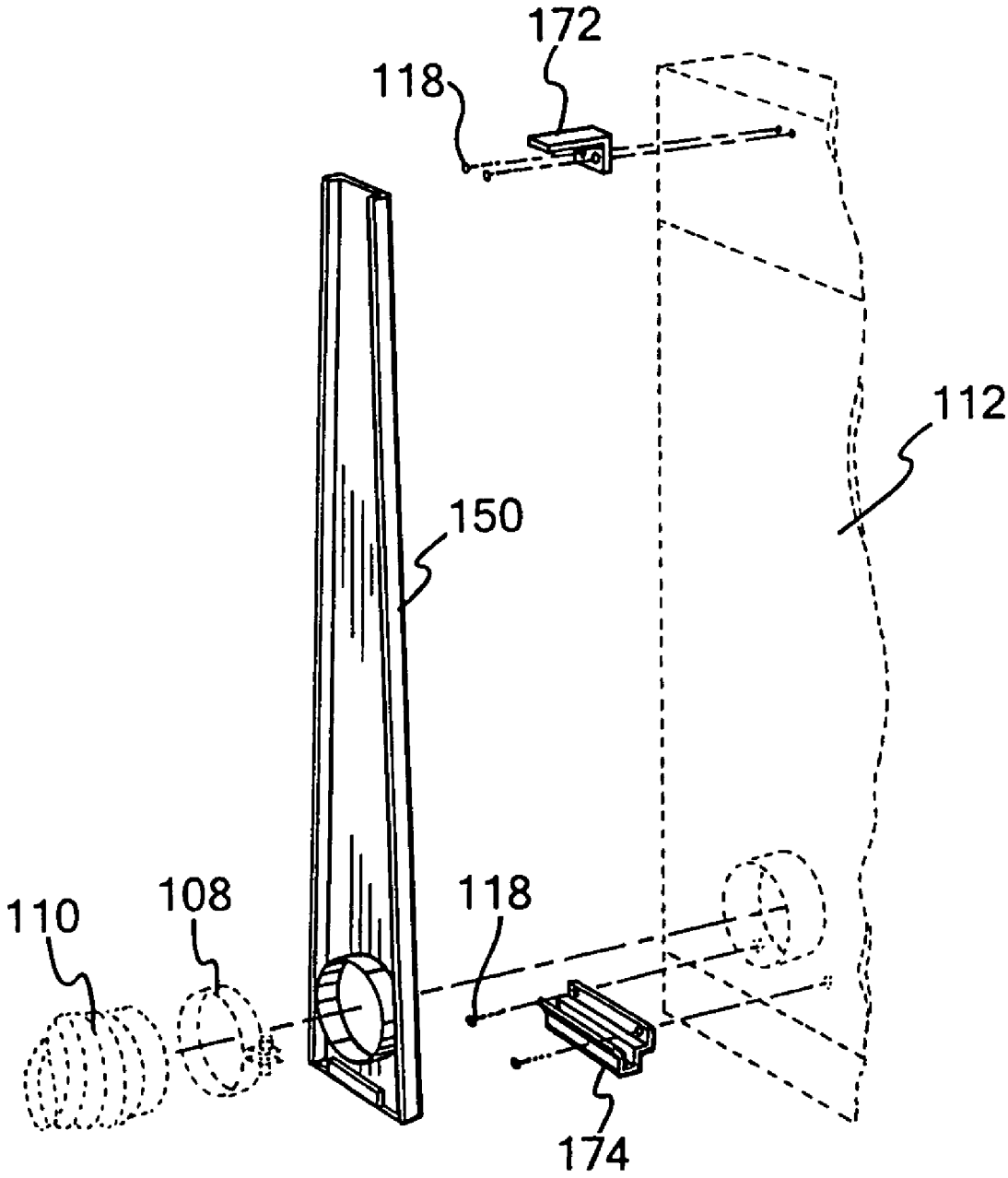
FIG. 14 depicts an exploded, perspective, reverse view of vent pipe bracket 150 mating with bottom mounting grip 174.
Figure 15:
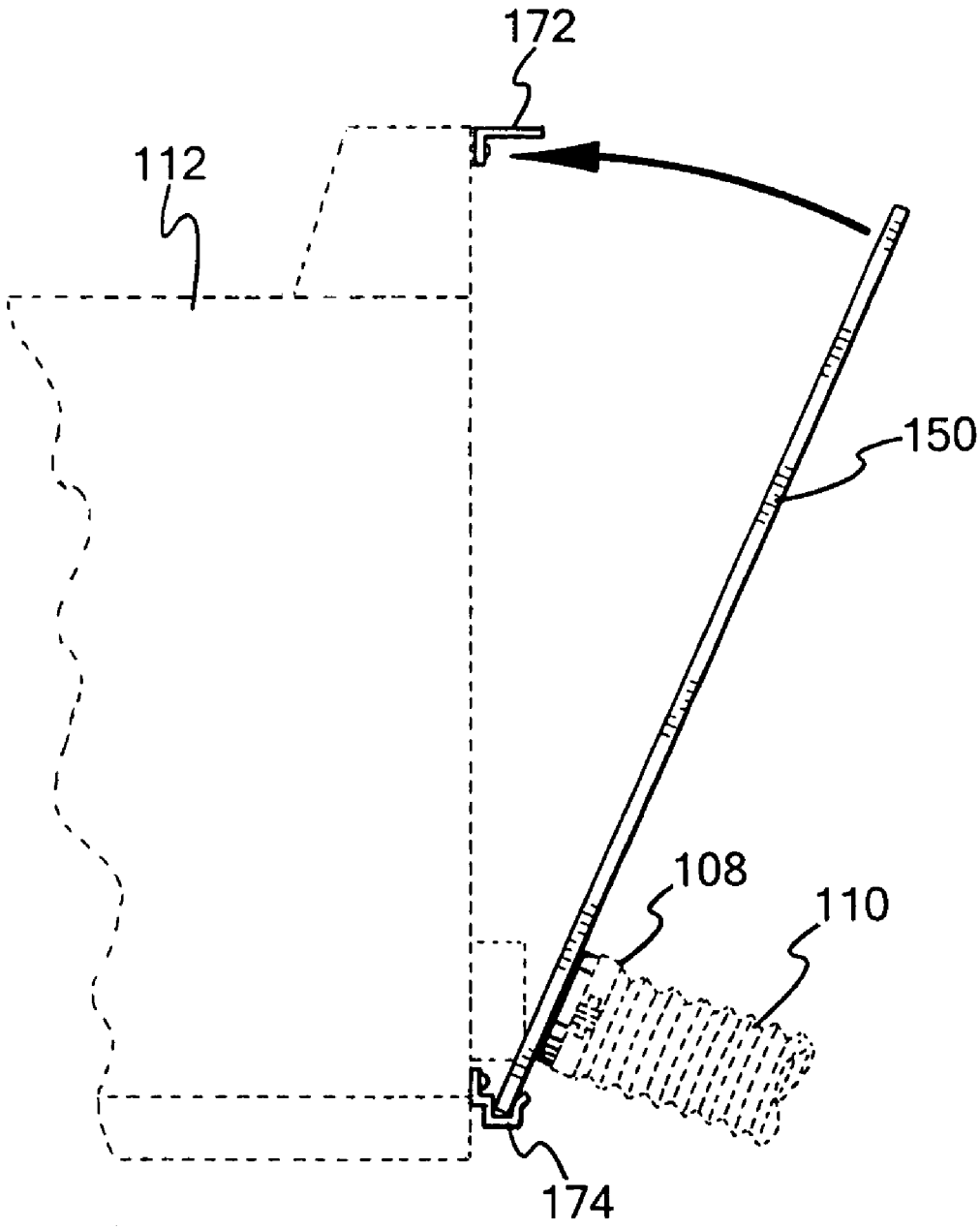
FIG. 15 depicts a side view of an alternative embodiment of the attachment device 100 for attaching to the dryer 112.

Referring now to FIG. 14 and FIG. 15, vent pipe bracket 150 is secured to the dryer 112 with top grip 172 the joined to dryer 112 by mounting screws 118. Additionally bottom mounting grip 174 is secured with mounting screws 118 or maybe manufactured as part of the dryer back. Over this structure, is secured exhaust hose 110 with hose clamp 108.

Figure 16:
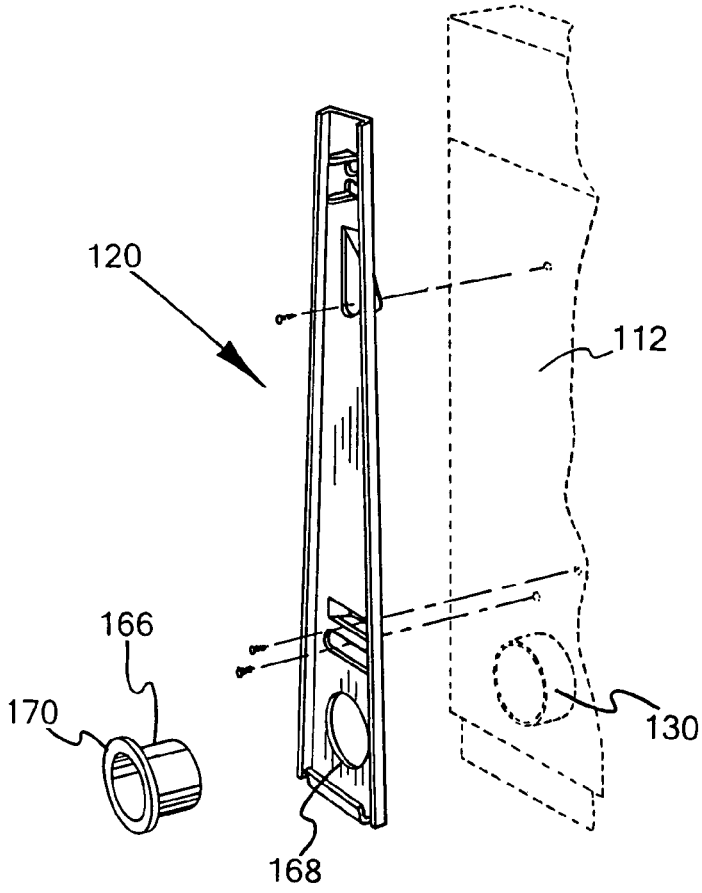
FIG. 16 depicts a side view of an alternative embodiment of the dryer bracket 120.

Referring now to FIG. 16, an alternate embodiment of the dryer bracket 120 is shown. Often adjustments must be made to the bracket collar 121 in order to appropriately fit the dryer bracket 120 in a selected location or within the dryer 112. In this embodiment, the bracket collar 121 is not an integral part of dryer bracket 120.

Slidable collar 166 slidably fits into a bracket aperture 168 and is stopped therein by collar flange 170. Upon installation of the dryer bracket 120, slidable collar 166 can be secured through the dryer bracket aperture 168. The separation of the dryer bracket 120 and slidable collar 166 facilitates measurement and trimming of the slidable bracket collar 121 at the work site if required. Consequently, the dryer bracket 120 can remain installed while the bracket collar 121 is being trimmed.

Figure 17:
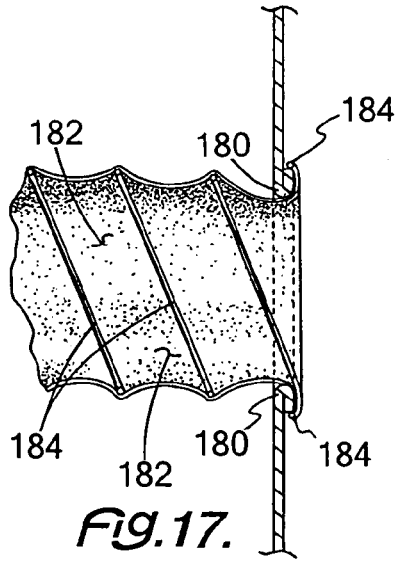
FIG. 17 depicts a side view of an alternative embodiment of the dryer bracket 120.

Referring now to FIG. 17, an alternative design permits the installation of the exhaust hose 110 to the vent pipe brackets 150 without a vent pipe collar 152 or hose clamp 108. Instead, a rolled edge 180 is used at the vent pipe bracket opening 188. Typical exhaust hoses 110 are made from a spring 184 surrounded by a flexible, sometimes plastic, sheath 182.

In this embodiment, the exhaust hose 110 is installed by compressing the first coil of spring 186 in the sheath so that the diameter is small enough to fit through the vent pipe bracket opening 188. The exhaust hose 110 is simply inserted and pulled through the opening and over the rolled edges 180. Rolled edges 180 allow installation of the exhaust hose 110 without damage to the plastic sheath 182.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular are. Such modifications are clearly covered by this disclosure.

What is claimed and sought to be protected by Letters Patent of the United States is:

1. A device for attaching an exhaust channel to a clothes dryer from the front of the clothes dryer without moving the dryer away from a wall comprising:
(a) the device including a dryer bracket and a vent pipe bracket for attachment of the exhaust channel to the dryer;
(b) the dryer bracket attaching to the back of the dryer;
(c) the dryer bracket having a bracket collar for insertion into a dryer collar within the dryer when dryer bracket is attached to the clothes dryer;
(d) the vent pipe bracket attaching to the dryer bracket;
(e) the exhaust channel attaching to the vent pipe bracket;
(f) the dryer bracket and the vent pipe bracket cooperating to attach the exhaust channel to the clothes dryer;
(g) the dryer bracket having a channel attaching to a housing base of the dryer bracket;
(h) at least two vent rails on an edge of the vent pipe bracket fitting within the channel for releasable joining the vent pipe bracket thereby securing the vent pipe bracket to the dryer bracket;
(i) the dryer bracket having first vertical side rail and a second vertical side rail oppositely disposed therefrom forming a tapered housing;
(j) the vent pipe bracket and the dryer bracket being releasably joinable;
(k) the vent pipe bracket consisting of two oppositely disposed vent rails and a vent base;
(l) the edge of the vent pipe bracket fitting within the channel being a bottom edge of the vent pipe bracket;
(m) the device being attachable between the clothes dryer and the exhaust channel; and
(n) the device requiring substantially less exhaust hose to attach the dryer to the exhaust channel.

2. The device of claim 1 further comprising:
(a) the bottom edge of the vent pipe bracket having a channel support;
(b) the channel support being releasably joinable to the dryer bracket channel; and
(c) the channel support fitting within the channel securing the vent pipe bracket to the dryer bracket.

3. The device of claim 2 further comprising the vent pipe bracket having an opening with rolled edges for attaching the exhaust channel to the vent pipe bracket by inserting the exhaust channel through the opening and over the rolled edges.

4. The device of claim 2 further comprising:
(a) the vent pipe bracket having a vent pipe collar extending away from the dryer and substantially aligning with bracket collar when vent pipe bracket is attached to the dryer bracket; and
(b) the exhaust channel attaching to the vent pipe collar thereby attaching the exhaust channel to the vent pipe bracket.

5. The device of claim 2 further comprising:
(a) the bracket collar being a slidable collar detaching from the dryer bracket; and
(b) the slidable collar attaching to the dryer bracket with a flange.

6. The device of claim 4 further comprising further comprising at least one mounting foot aperture for attaching the dryer bracket to the clothes dryer.

7. The device of claim 6 further comprising a handle for mounting the vent pipe bracket from the front of the clothes dryer.

8. The device of claim 7 further comprising:
(a) the dryer having at least one fastening device near the top of the dryer bracket and extending horizontally and away from the dryer;
(b) the vent pipe bracket having at least one cutout for receiving the at least one fastening device; and
(c) the at least one fastening device thereby securing the vent pipe bracket to the dryer bracket.

9. The device of claim 8 further comprising:
(a) the at least one mounting foot containing mounting foot apertures;
(b) the at least one mounting foot apertures aligning with at least one pilot aperture formed on a back portion of the dryer;
(c) a screw inserting through the mounting foot apertures and into the at least one pilot aperture thereby securely attaching the dryer bracket to the dryer.

10. The device of claim 9 further comprising:
(a) two lower mounting feet and an upper mounting foot;

(b) the two lower mounting feet positioning above the dryer collar;

(c) the two lower mounting feet facing parallel yet opposite direction and separating by a small vertical offset distance; and (d) the upper mounting foot being below the top of the bracket and pointing toward the bottom of the bracket.

11. In a clothes dryer having a bracket collar to receive an exhaust hose for the clothes dryer, the improvement comprising:

(a) a device being secured to the clothes dryer which cooperates with the exhaust hose and the bracket collar;

(b) the device including a dryer bracket and a vent pipe bracket for attachment of the exhaust channel to the dryer;

(c) the dryer bracket having a bracket collar for insertion into a dryer collar within the dryer when the dryer bracket is attached to dryer;

(d) the vent pipe bracket attaching to the dryer bracket;

(e) the exhaust channel attaching to the vent pipe bracket;

(f) the dryer bracket and the vent pipe bracket cooperating to attach the exhaust channel to the clothes dryer;

(g) the dryer bracket having a channel attaching to a housing base of the dryer bracket;

(h) at least two vent rails on an edge of the vent pipe bracket fitting within the channel for releasable joining the vent pipe bracket thereby securing the vent pipe bracket to the dryer bracket;

(i) the dryer bracket having first vertical side rail and a second vertical side rail oppositely disposed forming a tapered housing;

(j) the vent pipe bracket and the dryer bracket being releasably joinable;

(k) the vent pipe bracket consisting of two oppositely disposed vent rails and a vent base;

(l) the edge of the vent pipe bracket fitting within the channel being a bottom edge of the vent pipe bracket;

(m) a handle for mounting the vent pipe bracket from the front of the clothes dryer;

(n) the device being usable from the front of the dryer; and (o) the device requiring substantially less exhaust hose to attach the dryer to the exhaust channel.

12. The clothes dryer of claim 11 further comprising the edge of the vent pipe bracket fitting within the channel being a bottom edge of the vent pipe bracket.

13. The clothes dryer of claim 12 further comprising the dryer bracket having first vertical side rail and a second vertical side rail oppositely disposed forming a tapered housing.

14. The clothes dryer of claim 13 further comprising:

(a) the bottom edge of the vent pipe bracket having a channel support;

(b) the channel support being of similar shape to the channel; and (c) the channel support fitting within the channel securing the vent pipe bracket.

15. The clothes dryer of claim 14 further comprising:

(a) the handle having a front surface at a top portion thereof;

(b) the top portion being visible above the dryer; and (c) the front surface receiving information visible from the front of the dryer.

16. The clothes dryer of claim 15 further comprising:

(a) a top grip attaching to the back of the dryer; and (b) the top grip cooperating with a bottom grip thereby securing the vent pipe bracket to the dryer bracket.

* * * * *